US006094873A

United States Patent [19]

Hoffman et al.

[11] Patent Number: 6,094,873

[45] Date of Patent: Aug. 1, 2000

[54] FOUNDATION FOR MANUFACTURED HOMES

[76] Inventors: Keith M. Hoffman, 801 Delaware Ave., Ames, Iowa 50014; Bradley G. Hoffman, 8501 Ridgemont Dr., Urbandale, Iowa 50322; Rikel M. Hoffman, 621 Douglas Ave., Ames, Iowa 50010; Eric F. Horlyk, 1200 35th St., Suite 210, West Des Moines, Iowa 50266

[21] Appl. No.: 08/976,628

[22] Filed: Nov. 24, 1997

Related U.S. Application Data

[60] Provisional application No. 60/039,305, Feb. 6, 1997.

[51] Int. Cl.[7] ..... E04B 9/00

[52] U.S. Cl. ..... 52/126.6; 52/167.9; 52/294; 245/354.3; 245/354.5

[58] Field of Search ..... 52/126.6, 157, 52/167.9, 294, 295, 297, 741.15; 248/354.3–354.5

[56] References Cited

U.S. PATENT DOCUMENTS

| | | | |
|---|---|---|---|
| 3,638,377 | 2/1972 | Caspe | 52/167.4 |
| 3,918,229 | 11/1975 | Schweinberger | 52/295 |
| 4,037,373 | 7/1977 | Echtler | 52/159 X |
| 4,068,445 | 1/1978 | Bobbitt | 52/157 X |
| 4,125,975 | 11/1978 | Soble | 52/297 X |
| 4,738,061 | 4/1988 | Herndon . | |
| 4,766,706 | 8/1988 | Caspe | 52/1 |
| 4,785,593 | 11/1988 | Munoz, Jr. | 52/126.1 |
| 4,833,846 | 5/1989 | McFeetors et al. | 52/157 X |
| 4,930,270 | 6/1990 | Bevacqua | 52/297 X |
| 5,011,336 | 4/1991 | Hamilton . | |
| 5,066,168 | 11/1991 | Holdeman | 52/157 X |
| 5,363,610 | 11/1994 | Thomas et al. | 52/126.6 X |
| 5,515,655 | 5/1996 | Hoffmann | 52/126.6 |
| 5,575,593 | 11/1996 | Raaf . | |
| 5,595,366 | 1/1997 | Cusimano et al. | 52/126.6 X |
| 5,711,504 | 1/1998 | Cusimano | 52/126.6 X |
| 5,819,482 | 10/1998 | Belke et al. | 52/126.6 |
| 5,862,635 | 1/1999 | Linse et al. | 52/126.6 |

*Primary Examiner*—Richard Chilcot
*Attorney, Agent, or Firm*—Henderson & Sturm LLP

[57] ABSTRACT

A foundation support system for manufactured building structures comprising footings, vertically adjustable vertical support members, beam holders and intermediate beams. The intermediate beams being disposed transversely below the main beams of the structure to be supported. The intermediate beams are supported by the vertically adjustable vertical support members. One end of the vertical support members having a beam holder secured thereto for receivingly securing the intermediate beams. The other end of the vertical support member supported by a footing.

13 Claims, 11 Drawing Sheets

FOUNDATION FOR MANUFACTURED HOMES

CROSS REFERENCE TO RELATED APPLICATIONS

This application contains the disclosure from and claims the benefit under Title 35, United States Code, § 119(e) of the following U.S. Provisional Application: U.S. Provisional Application Ser. No. 60/039,305 filed Feb. 6, 1997, entitled E-Z SET FOUNDATION.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to modular and manufactured residential and commercial buildings, and more particularly, to a foundation support system for such residential and commercial buildings.

2. Description of the Related Art

Modular manufactured residential and commercial buildings have become increasingly popular in recent years. As the cost of new construction continues to rise, the relatively lower cost of modular manufactured residential or commercial buildings are attractive to many buyers. Over the past many years, much has changed in the design of modular manufactured residential and commercial buildings. Particularly in their size and weight. Whereas manufactured buildings were essentially limited to the trailer-house type of structures, now, more traditionally-styled manufactured buildings having large structural elements are available and in use. Throughout this specification, reference is often made to "modular" or "manufactured" buildings, structures or homes. It should be appreciated that such reference is intended to include both the "trailer-house" type structures on wheels, and the more permanent "traditionally-styled" manufactured buildings, structures or homes where the modular sections are trucked to the building site on flatbed trailers.

The evolution of the manufactured residential and commercial buildings and their increase in size and weight has led to several problems in the design of a foundation support system capable of providing the necessary strength and stability to support the structures. For example, previous foundation support systems for manufactured buildings are characterized by a plurality of dry-stack concrete blocks positioned on concrete pier footings. The concrete pier footings are designed to bear below the frost depth to eliminate heave problems associated with freezing and thawing cycles of the soil. The concrete blocks rest atop the concrete pier footings and are disposed between the concrete piers and the main support beams of the manufactured building.

Typical dry-stack concrete block foundation support systems are not designed to withstand the loads required by modern manufactured buildings and often crack or break under the higher stresses. As such, if a dry-stack block foundation support system is to be used, many concrete piers and concrete blocks are required to adequately support modern manufactured buildings. For example, a standard 28×60 foot manufactured residential home will require approximately sixty concrete piers and at least twice that many concrete blocks. The need for such a large number of piers and concrete blocks presents several problems. Foremost is cost. Additionally, great care must be taken to align the concrete piers and the concrete blocks thereon with the main support beams of the manufactured building. If the piers and blocks do not align with the main support beams, the concrete blocks will not properly transfer the load to the pier footings below.

Thus, there is a need in the industry for a foundation support system that can support the larger loads required by modern manufactured structures, yet requires fewer footings to properly support the structure. There is also a need in the industry for a foundation support system that can be slightly skewed or out of alignment with the main support beams of the manufactured structure, but still properly transfer the structure's loads to the footings.

Another problem with previous types of foundation support systems is that the previous systems are difficult to adjust vertically as required during installation of the manufactured building. For example, with dry-stack block foundation systems, vertical adjustment is essentially limited to shimming the main support beams of the manufactured building with respect to the dry-stack concrete support blocks. Shimming is not a precise method, and it is difficult to shim a large area while ensuring adequate surface bearing contact between the supporting surface and the shimmed members. Accordingly, there is also a need in the art for a foundation support system that easily adjusts in the vertical direction.

Another problem with previous foundation support systems is that if the concrete blocks shift or move only slightly, the blocks may end up partially resting on or against the soil. This presents a serious problem, since during periods of extreme temperature change, the soil will often heave, causing the concrete blocks partially resting on the soil to crack or break. For this reason, it is necessary that building owners frequently monitor the concrete blocks supporting their structure each spring and fall. Such damage to the concrete blocks, however, often goes undetected. Subsequently, when the concrete blocks shift or break, the structure will likewise shift, requiring a construction company or manufactured building dealer to properly reset the structure at a significant cost. As such, there is a need in the industry for a foundational support system that is not susceptible to soil heave and adequately secures the structure to the footings.

A further problem with previous foundation support systems, is that they are not capable of resisting lateral or uplift loads due to wind. Therefore, the manufactured buildings must be tied down with straps anchored into the soil. These tie-down straps are normally 12 gauge metal straps extending over the structure's main support beams or over the top of the structure and secured to anchors driven into the soil. As such, there is a need in the industry for a foundation support system that may eliminate the need for tie-down straps.

Another problem with previous foundation support systems, is that they are not capable of resisting lateral or uplift loads on the foundation support system due to earthquake loading. As such, there is a need in the industry for a foundation support system that may be used on manufactured buildings to resist earthquake induced lateral and uplift loads on the foundation support system.

It can therefore be seen that there is a real and continuing need for the development of an improved foundation support system for manufactured residential and commercial structures.

BRIEF SUMMARY OF THE INVENTION

The present invention discloses a foundation support system for manufactured buildings that comprises a series of intermediate support beams disposed below the manufactured structure's main support beams. The intermediate beams are in turn supported by vertical support members comprised of upper and lower vertical members disposed in a telescoping relationship to enable vertical adjustment. The upper vertical member has a beam holder secured to one end. The beam holder acts to secure the intermediate support beams to the vertical support member. The vertical support member is in turn supported by a footing.

In the preferred embodiment, the lower vertical member is set within a concrete pier footing designed to transfer the structural loads to the soil in a bearing capacity or friction capacity or both. In an alternate embodiment, the lower vertical member is part of a helical pier footing constructed of steel pipe or tubing with at least one helical plate fixed thereto. The helical pier footing is augured into the soil to the required depth sufficient to transfer the structural loads to the soil by bearing capacity or friction capacity or both. A precast concrete donut is preferably placed around the lower vertical member below grade to assist in resisting any lateral loads to which the structure may be subject. In yet another alternative embodiment, the lower vertical member is fixed to a baseplate anchored to solid bedrock by rock anchors.

The present invention also includes a method of preparing a foundation system for manufactured residential and commercial buildings. The preferred method comprises excavating a plurality of holes in the soil at predetermined locations to the desired depth to achieve adequate soil bearing capacity or soil friction capacity to support the structure. The depth of penetration into the soil is determined by the soil conditions of the particular site. A portion of the lower vertical support members are then positioned within the excavated holes. Concrete is poured into the excavated holes around the portion of the lower vertical support members disposed in the holes. It must be assured that the lower vertical support members are at the desired elevation and plumb before the concrete sets. After the concrete pier footings have set, the upper vertical support members having the beam holders secured at their upper end are placed in telescoping relationship with the lower vertical support members projecting a distance above the top of the pier footings. The structure is then moved over the vertical support members. The intermediate support beams are positioned on the beam holders and secured thereto. The upper vertical support members and intermediate beams thereon are raised, typically by hydraulic jacks, until the intermediate beams contact the main support beams of the manufactured building. When the structure and beams reach the desired elevation above grade, the upper vertical support members are secured in place with respect to the lower vertical support members.

An alternative to the above method eliminates the need for excavating the soil and poring a concrete pier footing. The method comprises auguring into the soil a helical pier footing which includes the lower vertical support member. The helical pier footing is augured to the desired depth to achieve adequate soil bearing capacity or soil friction capacity to support the structure. The depth of penetration into the soil is determined by the soil conditions of the particular site. The helical pier footing must be plumb as it enters the soil. A shallow circular excavation is made around the lower vertical support member projecting a distance above the soil. A precast, or cast-in-place concrete donut is placed over the lower vertical support member and rests in the shallow excavation. The precast donut is then covered with the excavated soil. The upper vertical support members having the beam holders secured at their upper end are placed in telescoping relationship with the lower vertical support members projecting a distance above grade. The structure is then moved over the vertical support members. The intermediate support beams are positioned on the beam holders and secured thereto. The upper vertical support members and intermediate beams thereon are raised, typically by hydraulic jacks, until the intermediate beams contact the main support beams of the manufactured building. When the structure and beams reach the desired elevation above grade, the upper vertical support members are secured in place with respect to the lower vertical support members.

In yet another alternative method, where the depth to bedrock is shallow, the soil and any weathered rock over the bedrock is excavated to expose a sound, solid bedrock surface. Holes are drilled into the bedrock surface for insertion of rock anchors. The rock anchors are inserted into the drilled holes and grouted in place. A baseplate having apertures therein for mateably receiving the rock anchors are placed over the rock anchors projecting from the bedrock. Non-shrink grout is packed between the baseplate and the bedrock surface. The baseplate is secured to the rock anchors by threaded nuts. The lower member of the vertical support member being fixed to the baseplate must be plumbed before packing the grout and securing the baseplate to the rock anchors. After the shallow excavations are backfilled, the upper vertical support members having the beam holders secured at their upper end are placed in telescoping relationship with the lower vertical support members projecting a distance above grade. The structure is then moved over the vertical support members. The intermediate support beams are positioned on the beam holders and secured thereto. The upper vertical support members and intermediate beams thereon are raised, typically by hydraulic jacks, until the intermediate beams contact the main support beams of the manufactured building. When the structure and beams reach the desired elevation above grade, the upper vertical support members are secured in place with respect to the lower vertical support members.

An object of the present invention is the provision of an improved foundation support system for manufactured residential and commercial buildings.

Another object of the present invention is the provision of an improved foundation support system that eliminates the need for dry-stack concrete blocks as supporting members.

Another objective of the present invention is the provision of a foundation support system that minimizes the number of support members and footings required to support the manufactured building.

Another objective of the present invention is the provision of a foundation support system that can withstand the large loads transferred by modem manufactured buildings.

Another objective of the present invention is the provision of a foundation support system that can be easily adjusted in a vertical direction.

Another object of the present invention is the provision of a foundation support system that allows for some skewing or misalignment between the main floor beams of the structure and the footings, yet still adequately transfer the structure's loads to the footings.

Another objective of the present invention is the provision of a foundation support system that can adequately resist uplift and lateral loading due to wind to which the structure may be subject without having to use tie-down straps and anchors.

Another object of the present invention is the provision of a foundation support system that is capable of resisting lateral and uplift loading on the foundation support system due to earthquake loading.

These and other features, objectives, and advantages will become apparent to those skilled in the art with reference to the accompanying specification.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
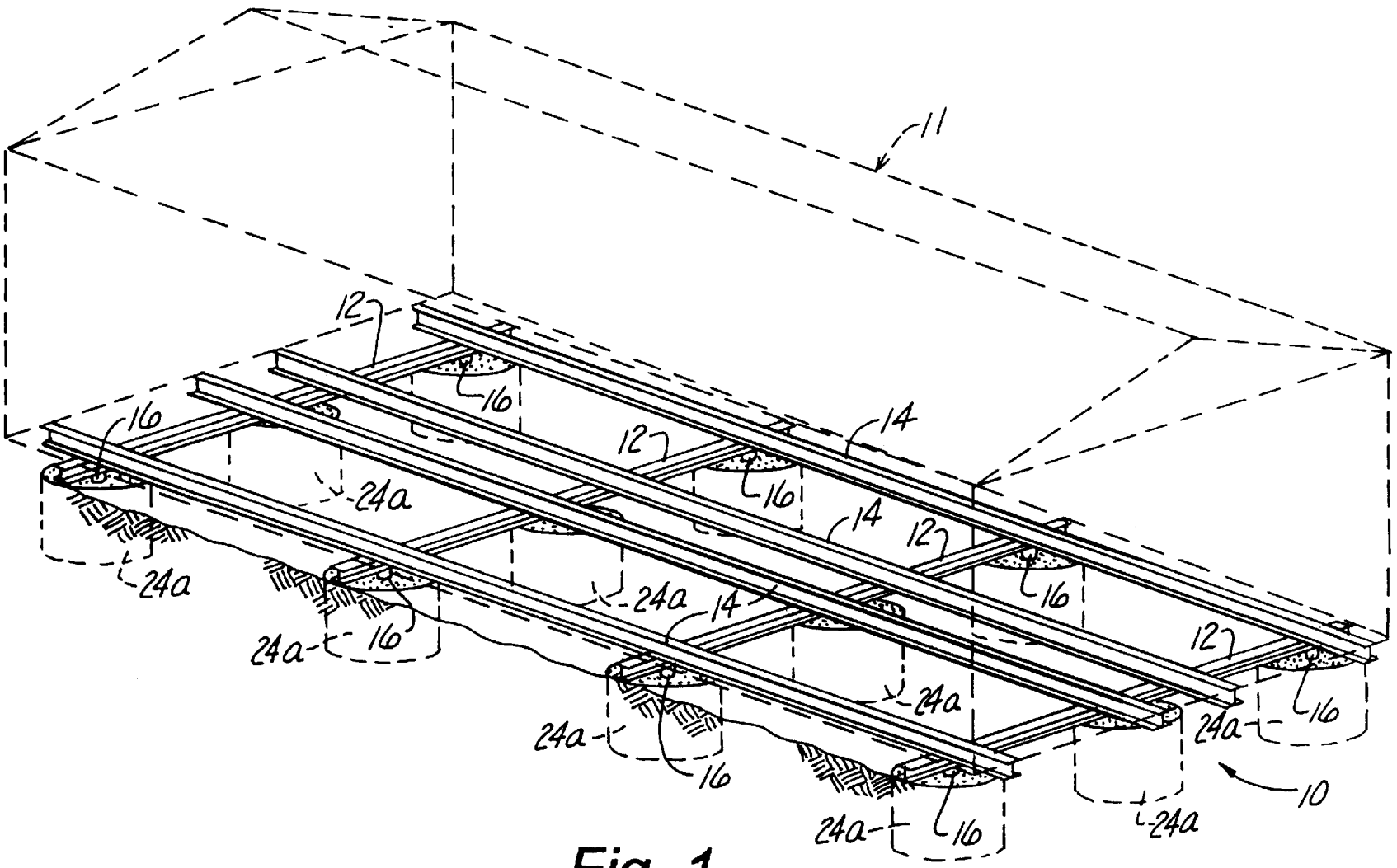
FIG. 1 is a perspective view of the preferred foundation support system of the present invention.
Figure 2:
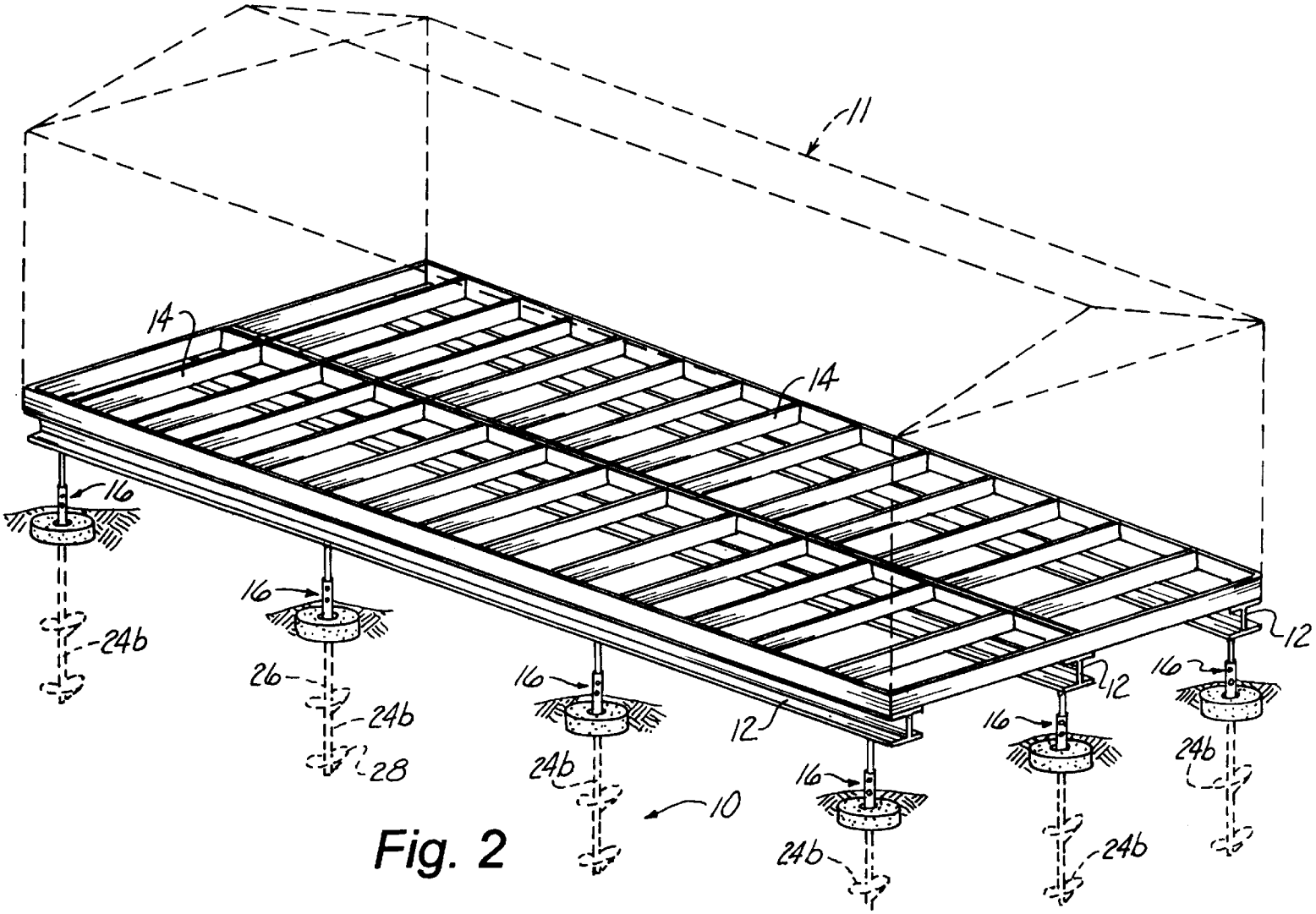
FIG. 2 is a perspective view of an alternate embodiment of the foundation support system of the present invention.
Figure 3:
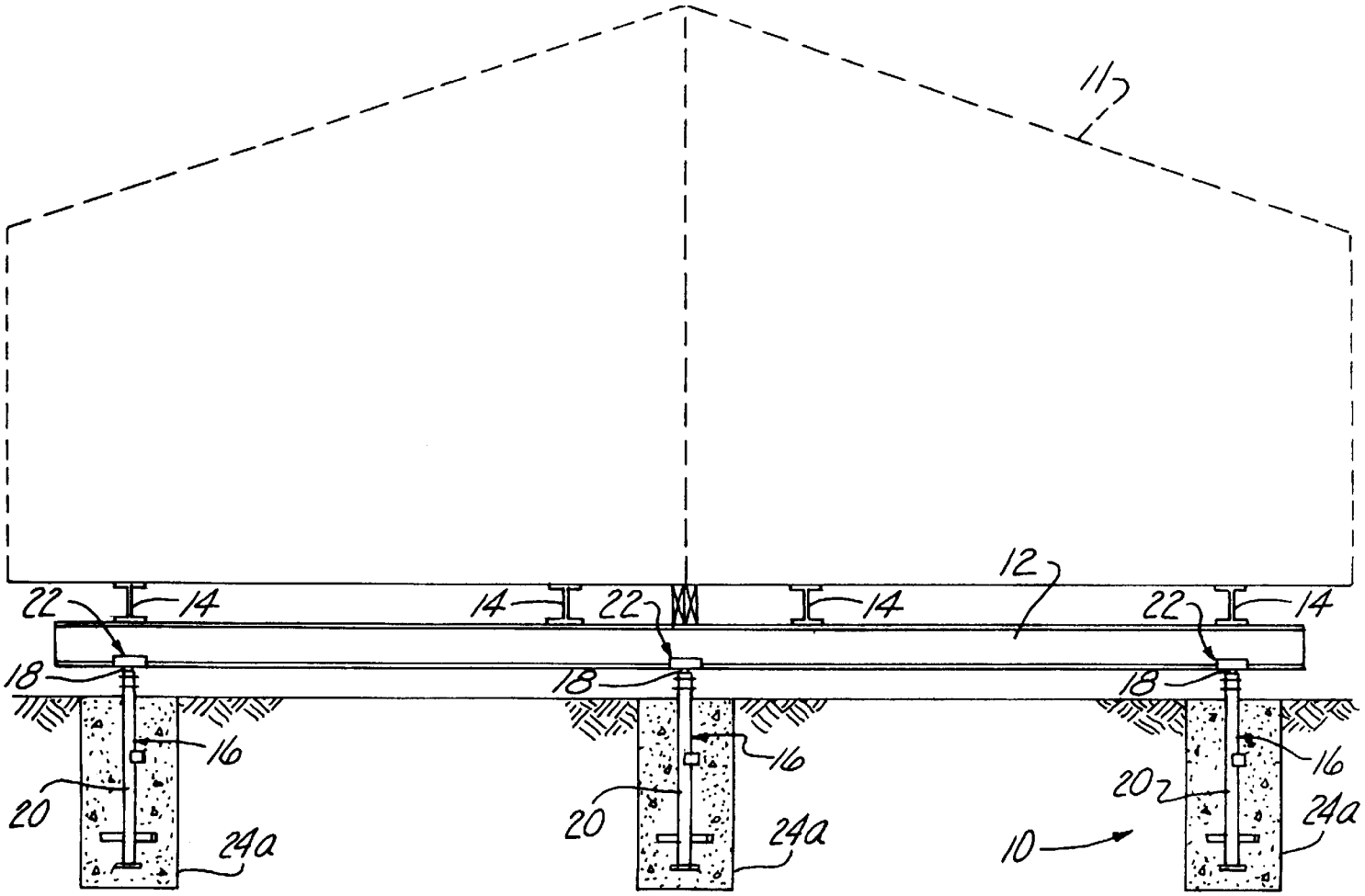
FIG. 3 is a side view of the foundation support system of FIG. 1.
Figure 4:
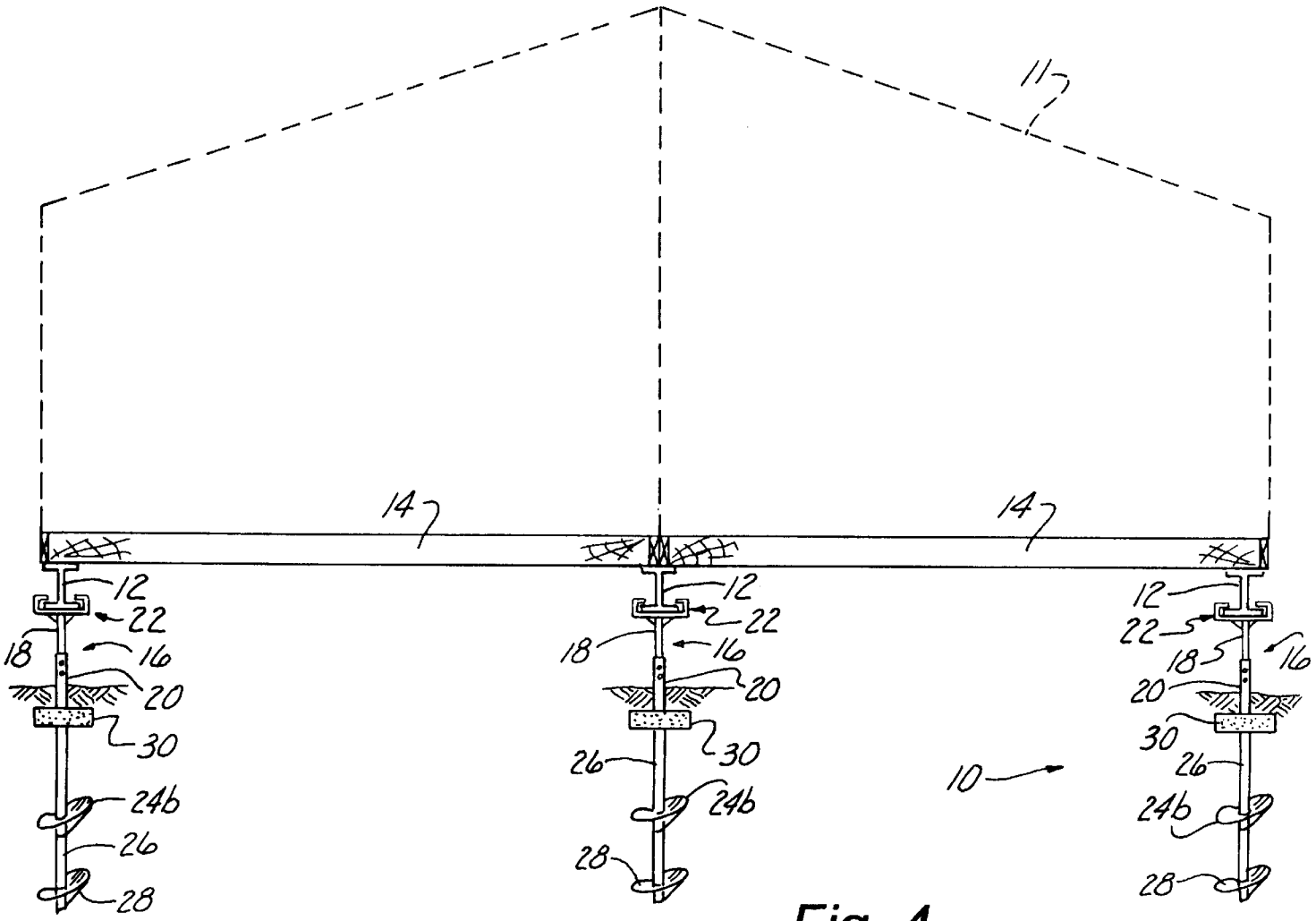
FIG. 4 is a side view of the foundation support system of FIG. 2.

Referring now to the drawings, wherein like reference numerals designate identical or corresponding parts throughout the several views, FIGS. 1–4 show the foundation support system of the present invention depicted generally at (10) installed below a typical manufactured structure (11), such structure being a manufactured or modular residential or commercial building. The foundation support system (10) includes of a series of intermediate support beams (12) disposed below the structure's main support beams (14). The intermediate support beams (12) are preferably steel wide-flange beams that are designed to adequately support the structure with an allowable deflection. Typical sizes of intermediate support beams (12) for an average 60×28 foot manufactured home may be a W 10×19 or a W 10×15. It should be appreciated that the structure's main support beams (14) may be longitudinally disposed steel wide-flange beams found in standard trailer-house type manufactured buildings as depicted in FIGS. 1 and 3, or the main support beams (14) may be wood floorjoists found in typical modular buildings as shown in FIGS. 2 and 4.

The intermediate beams (12) are supported by vertical support members (16) comprised of upper and lower members (18 and 20) (FIGS. 3 and 4) disposed in a telescoping relationship to enable vertical adjustment (discussed later). The upper members (18) of the vertical support members (16) have a beam holder (22) secured to one end, preferably by welding. The beam holder (22) acts to secure the intermediate support beams (12) to the vertical support members (16) (discussed in further detail later). The vertical support members (16) are in turn supported by footings (24).

Footings

Figure 9:
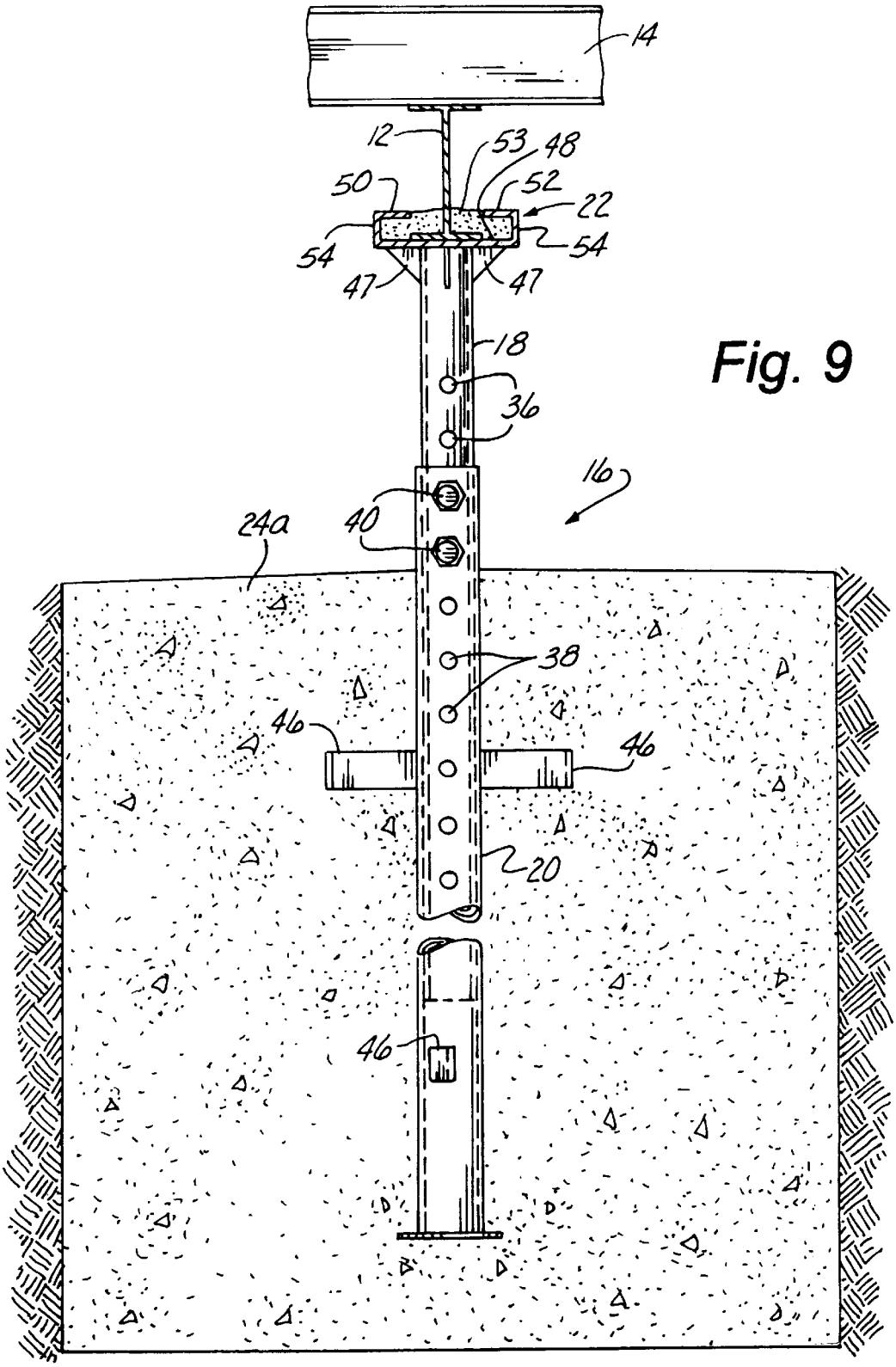
FIG. 9 is an enlarged view of the foundation support system of FIG. 3.

In the preferred embodiment, the footings (24) are concrete pier footings (24*a*) as shown in FIGS. 1, 3 and 9. The concrete pier footings (24*a*) are designed to transfer the loads of the building (11) to the soil in a bearing capacity or friction capacity or both. The concrete pier footings (24*a*) must also bear below frost depth of the soil to prevent potential movement of the concrete pier footings (24*a*) due to soil heave resulting from freezing and thawing cycles. The width and depth of the concrete pier footings (24*a*) depends primarily upon the net allowable soil bearing capacity of the soil. However, a diameter between three and four feet at a depth of four feet has been found suitable for most applications. The preferred concrete compressive strength for the pier footings is 3000 psi at twenty eight days.

Figure 10:
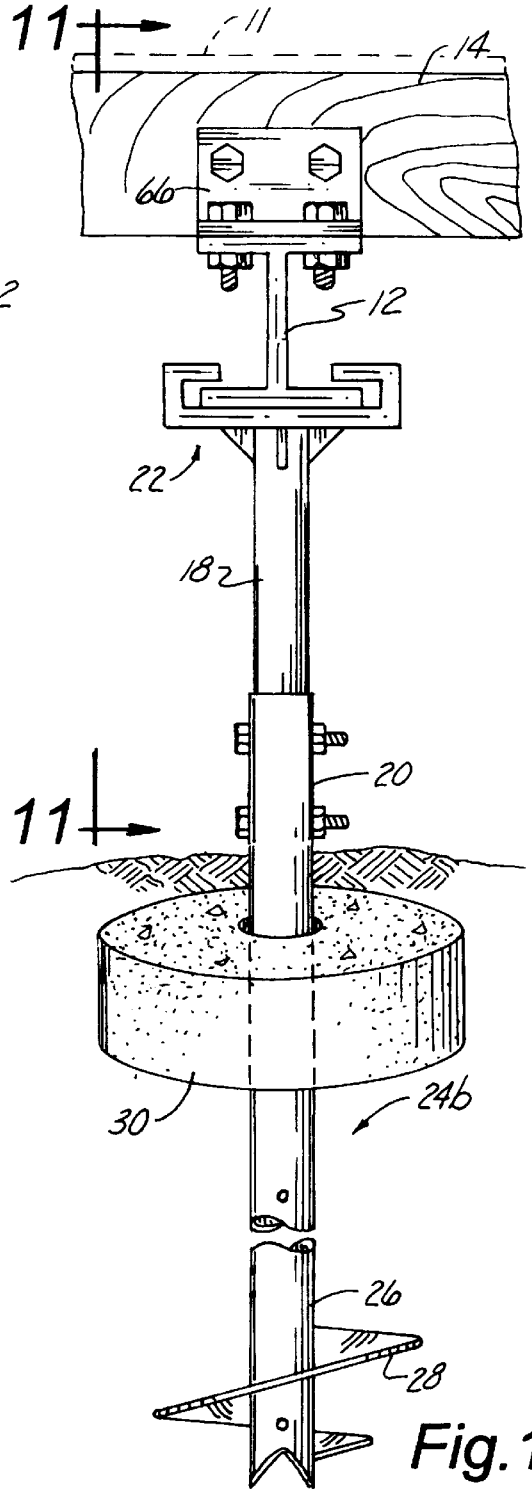
FIG. 10 is an enlarged view of the foundation support system of FIG. 4.

In an alternate embodiment, the footings (24) are helical pier footings (24*b*) as shown in FIGS. 2, 4 and 10. The helical pier footings (24*b*) are constructed of a steel pipe or tubing (26) with at least one helical plate (28) fixed thereto, preferably by welding. The pipe or tubing (26) is preferably 2½ inch A53 grade B, schedule 80 pipe. The helical plate (28) is preferably constructed of ⅜ inch ASTM A572 grade 50 steel. The helical pier footings (24*b*) are augured into the soil to the required depth sufficient to transfer the structural loads of the building (11) to the soil by bearing capacity or friction capacity or both. The helical pier footings (24*b*) must also bear below frost depth of the soil for the reasons discussed above. When using the helical pier footing (24*b*), it is recommended that a precast or cast-in-place concrete donut (30) (FIGS. 2, 4 and 10), being approximately twelve to eighteen inches in diameter and four to six inches thick having a center bore of approximately four inches in diameter, be placed around the steel pipe or tube (26) one or two feet below grade to assist in resisting any lateral loads to which the structure may be subject.

Figure 12:
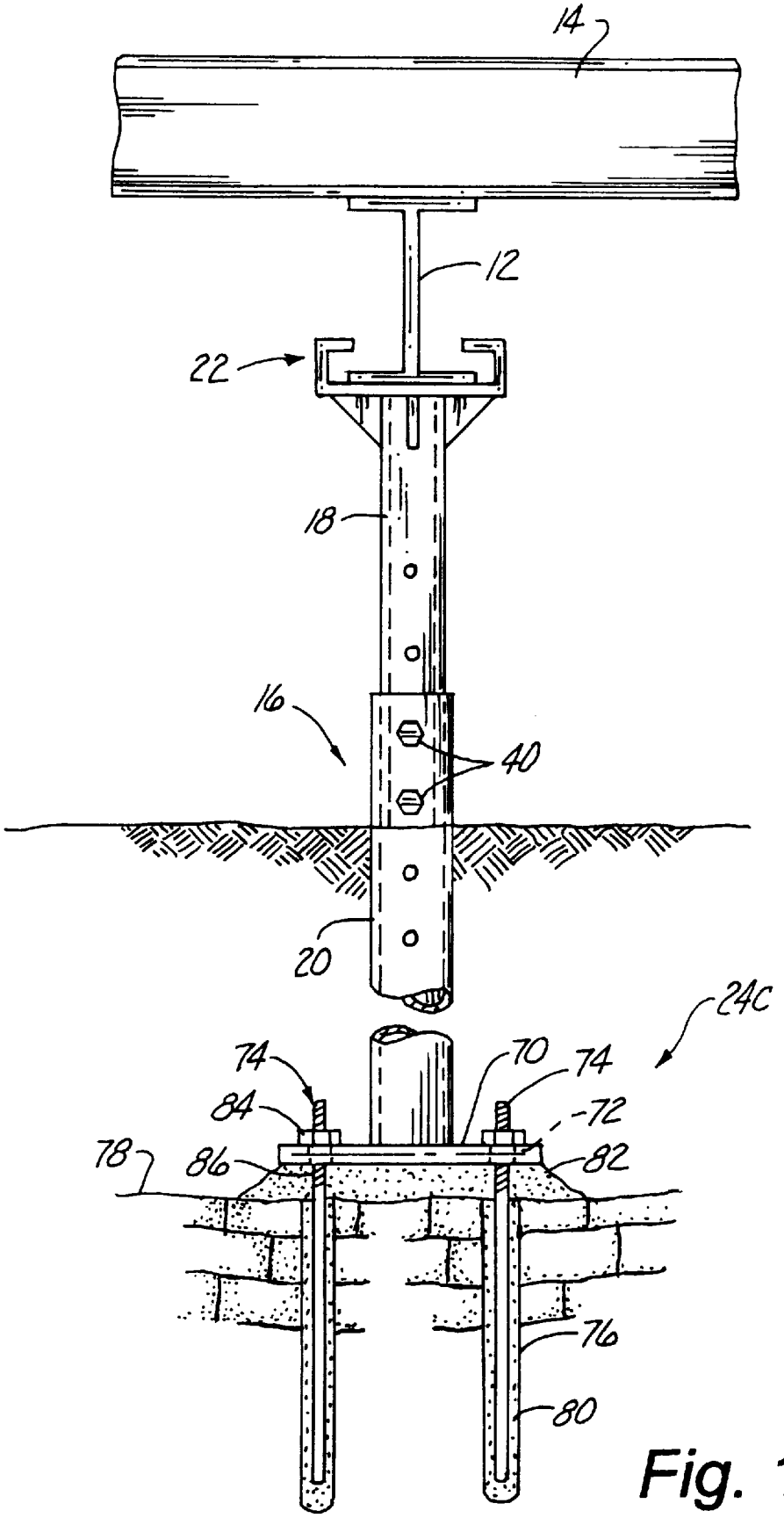
FIG. 12 is an elevation view of an alternate embodiment of foundation support system utilizing rock anchors.

In yet another alternate embodiment, the footings (24) are rock anchored footings (24*c*) (FIG. 12). The rock anchored footings (24*c*) are comprised of a baseplate (70) having apertures (72) therein. Rock anchors (74) are grouted into holes (76) drilled into sound bedrock (78) with non-shrink grout (80). The baseplate (70) is momentarily supported above the bedrock surface (78) by a first set of nuts (86) threaded onto the rock anchors (74). A second set of nuts (84) secures the baseplate (70) to the rock anchors (74). Between the baseplate (70) and the bedrock (78), more non-shrink grout (82) is dry packed, thus ensuring adequate surface bearing contact for the baseplate (70). The lower member (20) of the vertical support member (16) is fixed to the baseplate (70) preferably by welding.

Adjustable Vertical Support Members

Figure 5:
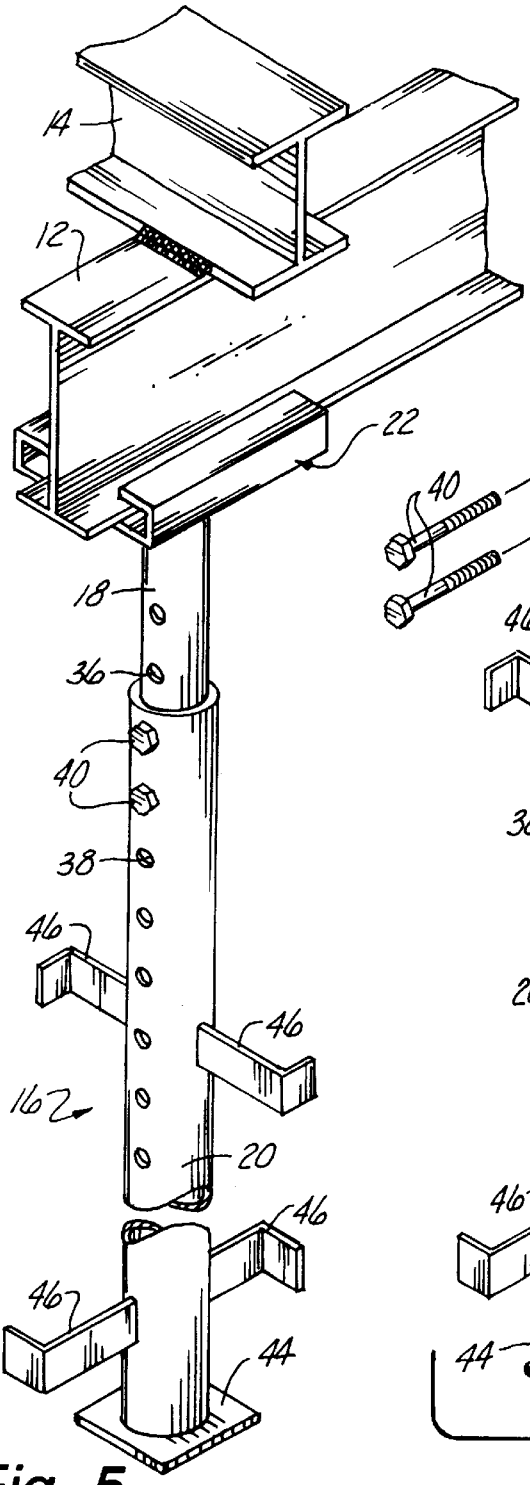
FIG. 5 is a perspective view of the preferred embodiment of an adjustable vertical support member and beam holder of the present invention with an intermediate support beam mounted thereon supporting a structure's main support beam.
Figure 6:
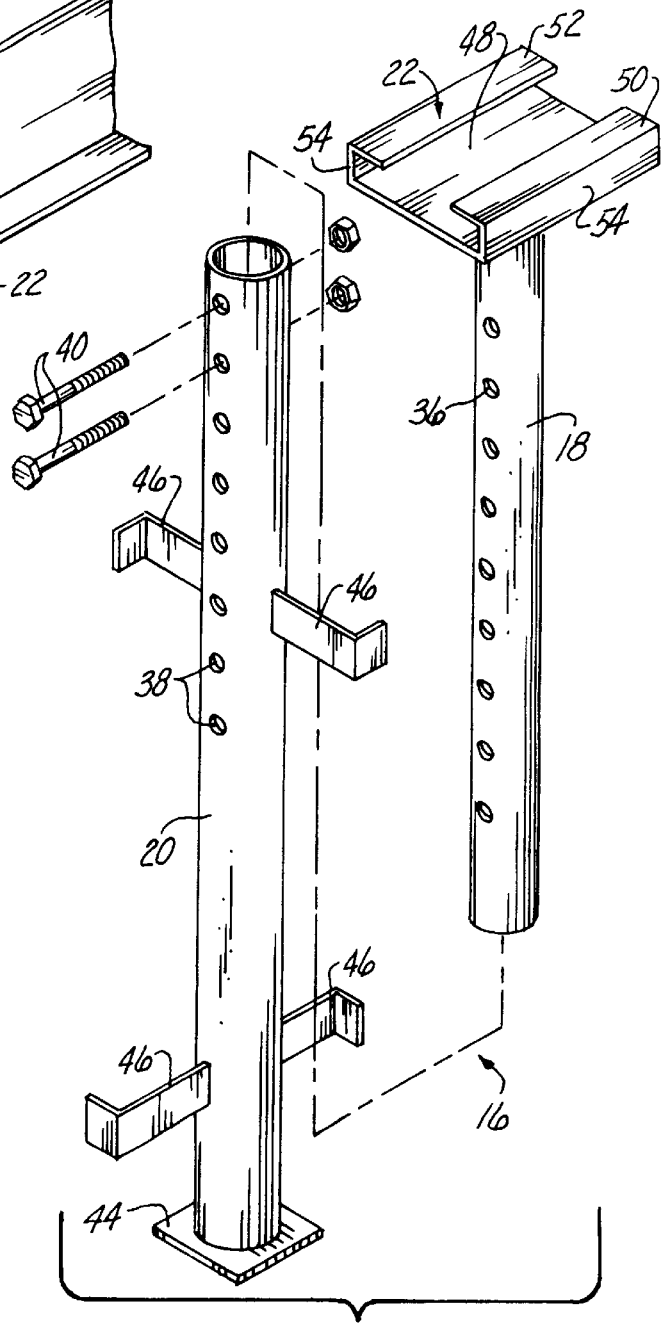
FIG. 6 is an exploded perspective view of the vertical support member and beam holder of FIG. 5.

The vertical support member (16) of the preferred embodiment, is shown most clearly in FIGS. 5 and 6. The vertical support member (16) includes a lower vertical support member (20) and an upper vertical support member (18). The upper vertical member (18) is preferably constructed of 2 inch diameter, ASTM A53 grade B, schedule 40 pipe, and lower vertical member (20) is preferably constructed of 2½ inch diameter, ASTM A53 grade B, schedule 80 pipe. It should be appreciated that square tubing, or any structural shape that can be oriented in a telescoping relationship may be used for upper and lower members (18 and 20) of the vertical support members (16).

In the preferred embodiment, shown in FIGS. 5 and 6, the longitudinal axis of the upper vertical support member (18) is substantially aligned with the longitudinal axis of the lower vertical support member (20) and sized such that at least a portion of the upper vertical support member (18) is capable of being disposed within the lower vertical support member (20) in a telescoping relationship. Both the upper and lower vertical support members (18 an 20) include a plurality of apertures (36 and 38) which may be aligned to receive a conventional fastener (40), such as a bolt secured by a nut. It should be appreciated that the telescoping relationship of the upper and lower vertical support members (18 and 20) permits the vertical support members (16) to be easily adjusted in the vertical direction. It is recommend that at least two ¾ inch, ASTM A325 high strength steel bolt fasteners (40) be used to secure the upper and lower members (18 and 20) of the vertical support member (16).

The lower vertical support member (20) further includes a base plate (44)fixed to one end, preferably by welding. The base plate (44) provides a larger area to resist punching shear of the concrete pier footing (24*a*). A layer of reinforcing steel (not shown) may also be placed near the bottom of the pier footing (24*a*) and below the base plate (44) to resist punching shear. The lower vertical member (20) further includes L-shaped anchors (46) fixed to its outside periphery, preferably by welding. The anchors (46) act to resists rotation and rigidly secure the lower vertical support member (20) into the concrete pier footing (24*a*).

Figure 7:
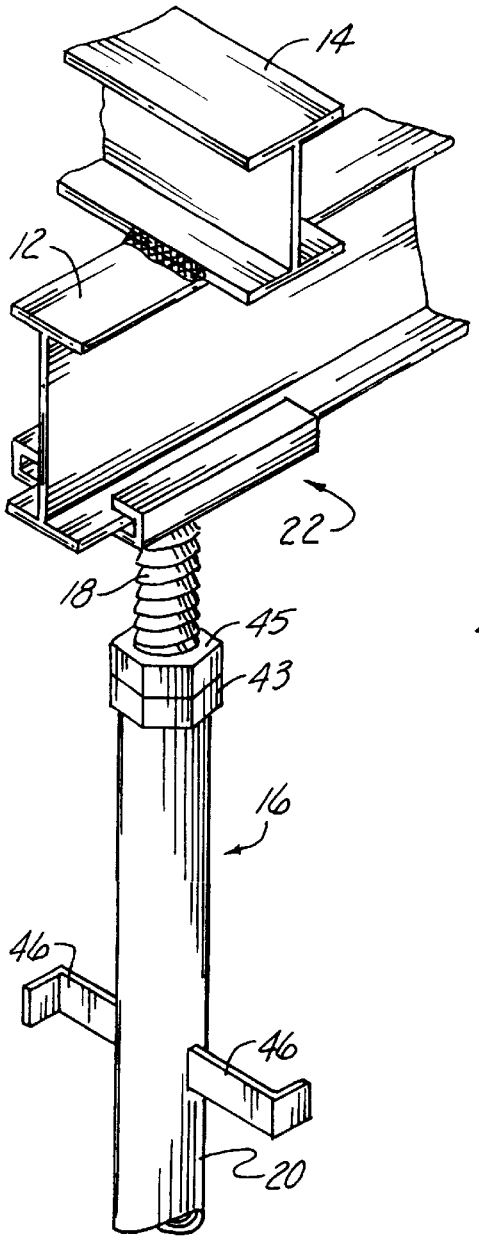
FIG. 7 is a perspective view of an alternate embodiment of an adjustable vertical support member of the present invention with an intermediate support beam mounted thereon supporting a structure's main support beam.
Figure 8:
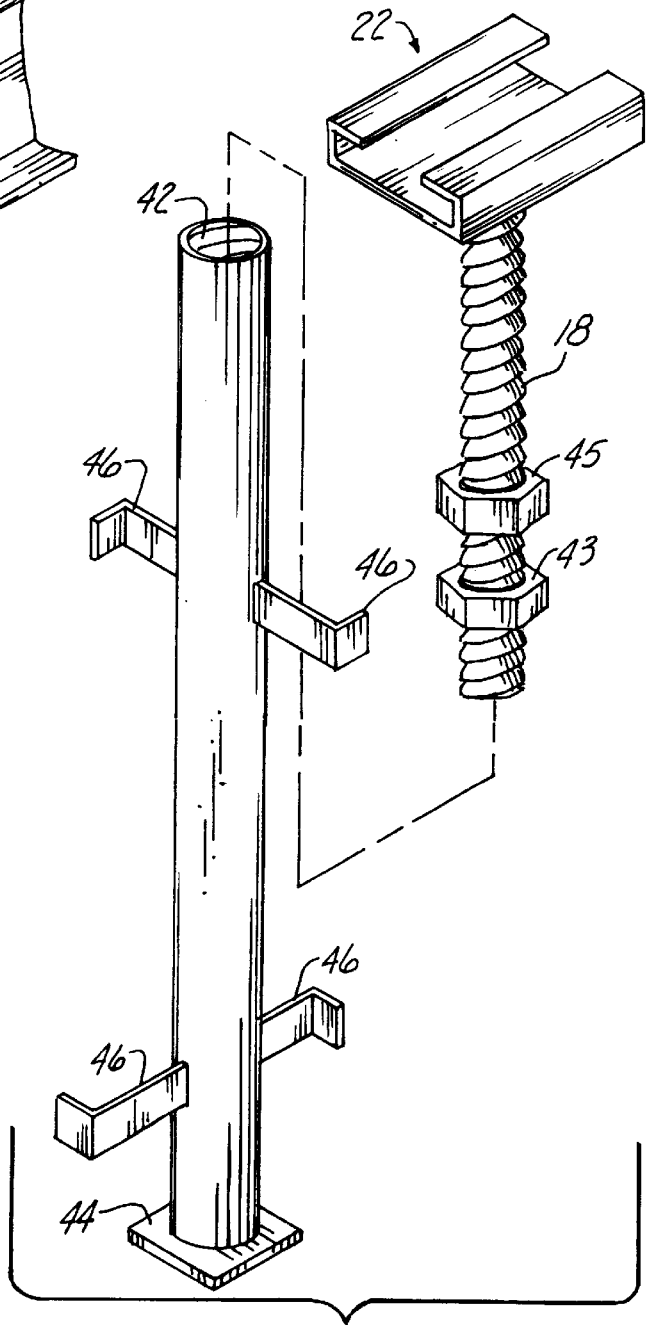
FIG. 8 is an exploded perspective view of the vertical support member of FIG. 7.

An alternative embodiment for the telescoping relationship of the upper and lower members (18 and 20) of the vertical support member (16) is illustrated in FIGS. 7 and 8. Rather than utilizing bolted fasteners (40) insertable into aligned apertures (36 and 38) of the upper and lower members (18 and 20), the lower member (20) may be a pipe having internal threads (42) for threadably receiving a threaded upper member (18). With the upper member (18) threaded into the lower member (20) to the desired elevation, a securing nut (43) may be turned down until it contacts the top of the lower member (20). A second locking nut (45) may then be turned down onto the first securing nut (43), thereby locking the members (18 and 20) together to prevent further turning. Alternatively, a single nut (43) may be employed and tack welded to the upper and lower members (18 and 20) thus locking them together to prevent further turning.

When using the alternate helical pier footing (24*b*) embodiment (best illustrated in FIG. 10), the lower member (20) of the vertical support member (16) is the same member as the steel pipe or tubing (26) comprising the helical pier footing (24*b*).

Additionally, when using the alternate rock anchor footing (24*c*) embodiment, the lower member (20) of the vertical support member (16) is fixed to the baseplate (70) (see FIG. 12).

Beam Holder

The preferred embodiment of the beam holder (22) is shown in FIGS. 5 and 6 secured to the top of the upper vertical support member (18), preferably by welding. Gusset plates (47) (FIG. 9) may be welded to the beam holder (22) and the upper vertical member (18) to stiffen the connection. The beam holder (22) includes a bottom plate (48) and two inwardly opposed spaced apart top flanges (50 and 52) connected by webs (54) for receiving the intermediate support beam (12). As best viewed in FIG. 5, the flange and web of the intermediate support beam (12) slides between the spaced apart top flanges (50 and 52) and between the spaced apart bottom plate (48) and top flanges (50 and 52) of the beam holder (22). Non-shrink grout (53) (FIG. 9) is then packed around the intermediate support beam (12) within the beam holder (22) to rigidly fix the members (12 and 22) together. Alternatively, the two members (12 and 22) could be tack welded together. It is recommended that all structural and plate steel used in the foundation support system (10), not designated otherwise, be ASTM A36 grade steel. It is also recommended that the steel be hot dipped galvanized per ASTM A123 Class 100 or finished primed to prevent corrosion.

Figure 13:
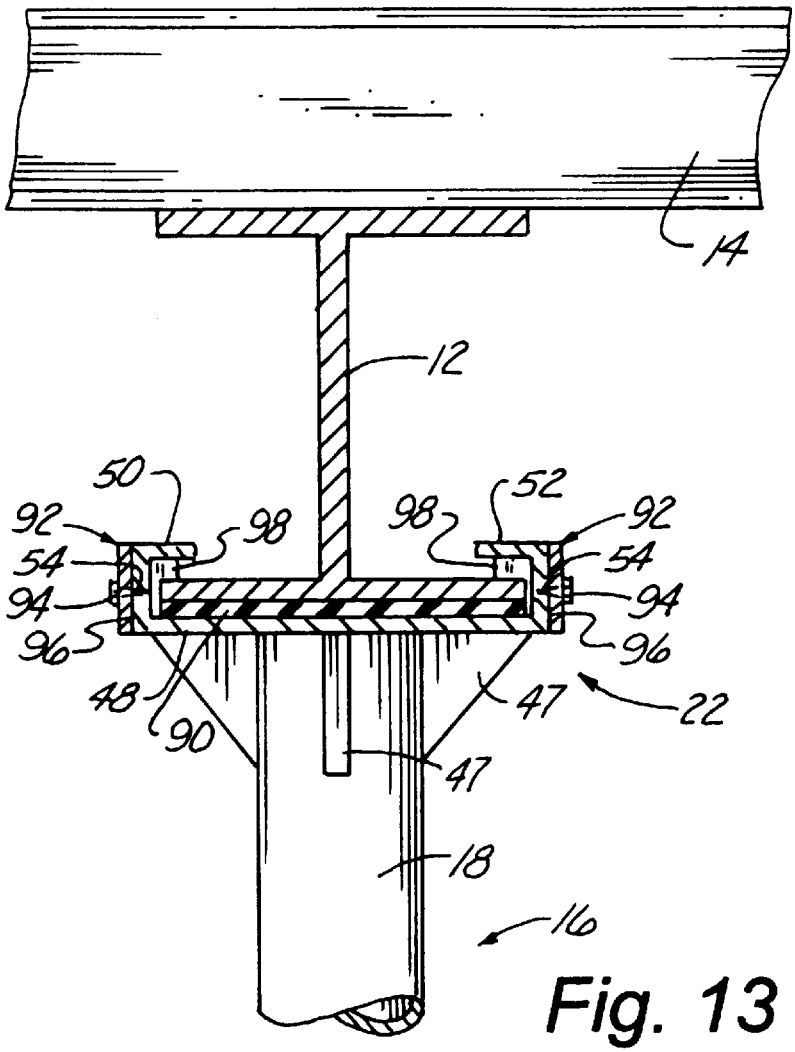
FIG. 13 is an enlarged view of the preferred beam holder for use in seismic zones.
Figure 14:
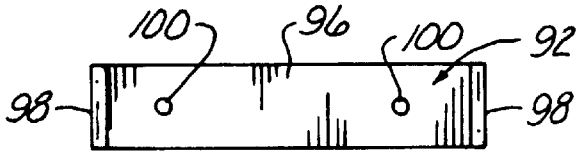
FIG. 14 is a plan view of the retainer for the beam holder of FIG. 13.
Figure 15:
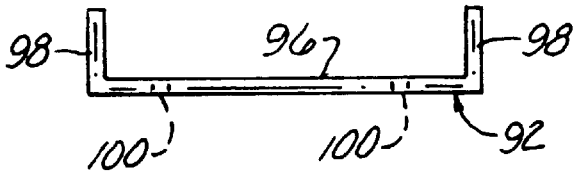
FIG. 15 is an elevation view of the retainer of FIG. 14.

When the manufactured building (11) is to be located in a seismic zone, it is preferable that the beam holder (22) be modified such that earthquake induced lateral loads are dampened between the interface of the intermediate beam (12) and the beam holder (22). FIG. 13 illustrates the preferred seismic beam holder detail. As can be seen from FIG. 13, the beam holder (22) is substantially the same as that described above, except that a neoprene pad (90) is disposed between the intermediate beam (12) and the bottom plate (48) of the beam holder (22). The neoprene pad (90) acts as a cushion to allow the intermediate beam (12) to move laterally within the beam holder (22) somewhat independently of the beam holder (22). This independent movement, acts to dampen the lateral movement of the beam (12) during seismic activity. The neoprene pad (90) is preferably substantially the same size as the bottom flange of the intermediate beam (12) and is ½ inch in thickness with a durometer of 90. The neoprene pad (90) is restrained within the beam holder (22) by a pair of bent plate retainers (92) (FIGS. 14 and 15) secured to the webs (54) of the beam holder (22) by self drilling tapping screws (94). As shown in FIGS. 14 and 15, the retainers (92) are C-shaped members having a web (96) and two flanges (98). The web (96) includes two apertures (100) for the tapping screws (94). It should be appreciated, that when viewing FIG. 13, the flanges (98) retain the neoprene pad (90) within beam holder (22). It should be appreciated that the neoprene pad (90) may also be restrained within the beam holder (22) by a number of other means, including, among others, by bonding the neoprene pad (90) directly to the bottom plate (48) of the beam holder (22).

Figure 16:
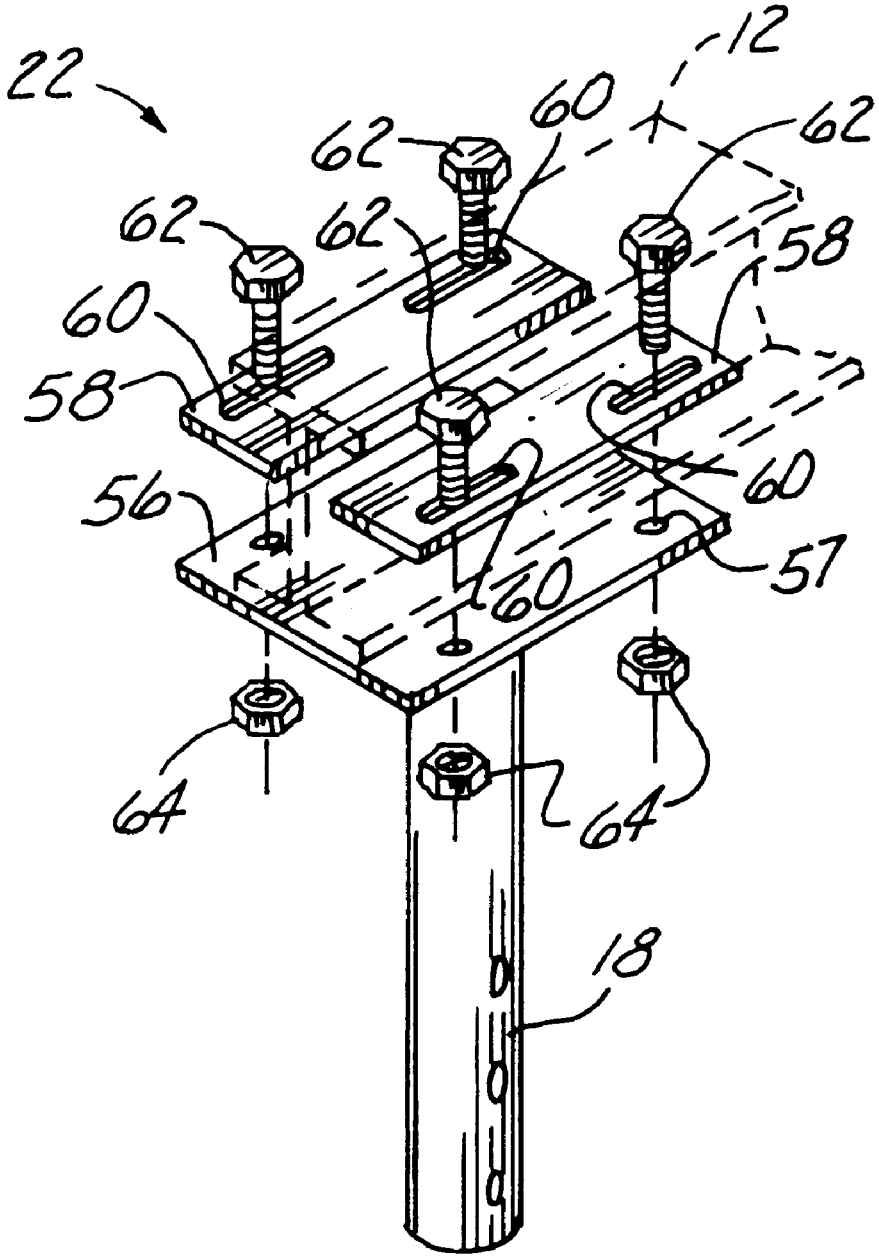
FIG. 16 is a perspective view of an alternate beam holder

An alternate embodiment of the beam holder (22) is shown in FIG. 16. In this embodiment, a rectangular bottom plate (56) is fixed to the upper vertical support member (18) by welding. The rectangular bottom plate (56) includes four holes (57) near each corner. A pair of top plates (58) include two slotted holes (60) for receiving threaded fasteners (62) which extend through the top and bottom plates (58 and 60) and are secured with nuts (64). The top and bottom plates (58 and 60) secured by the threaded fasteners (62) and nuts (64) act as pinch-clamps thereby securing the intermediate support beam (12) to the vertical support member (16).

Figure 11:
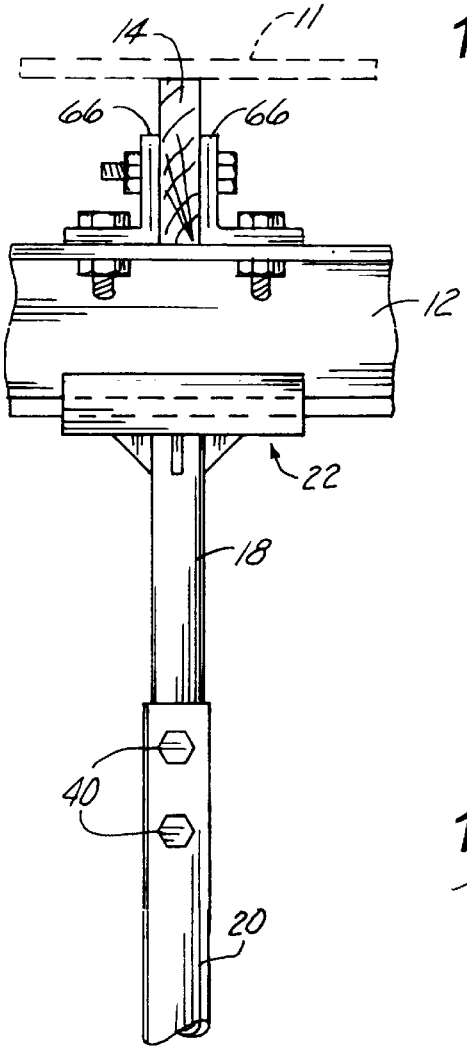
FIG. 11 is a view taken along lines 11—11 of FIG. 10.

The manufactured building (11) must be secured to the foundation support system (10) to ensure the building (11) does not move with respect to the foundation (10). If the structure's main beams (14) are wide-flange members, as is typical in standard trailer-house type manufactured buildings, the flanges of the main beams (14) may be welded to the flanges of the intermediate beams (12) as shown in FIGS. 5 and 7, or alternatively bolted or clamped together. If the structure's main beams (14) are wood joists, as is typical in the more traditionally styled modular manufactured buildings, the wood joist main beams (14) must be secured to the intermediate support beams (12) by, for example, brackets (66) (FIG. 11) fixed to the wood joists that bolt to the flanges of the intermediate support beams (12) or alternatively secured by some other means, such as J-bolts.

Installation Method of Preferred Embodiment

When installing the preferred foundation support system (10) of the present invention, the first step is to lay out the locations of the concrete pier footings (24*a*) to adequately support the structure (11). The size and location of the concrete pier footings (24*a*) depends on the structure (11) and the soil conditions of the site. For a typical 60×28 foot manufactured building (11), the foundation support system (10) is preferably comprised of four rows of three concrete piers (24*a*) (see FIG. 1). The four transversely disposed rows are preferably spaced eighteen feet on center and three feet from each end. The spacing of the piers (24*a*) in the longitudinal direction are preferably spaced nine feet on center and two feet six inches from each end.

After the pier footings (24*a*) are laid out, the holes for the piers (24*a*) are excavated in the soil. After the holes for the piers (24*a*) have been excavated, the lower members (20) of the vertical support members (16) are placed partially within the hole and plumbed. Next, concrete is poured into the holes around the lower vertical support members (20). Final adjustments are then made to the lower vertical support members (20) such that they are all plumb and in the proper position with their top ends at the proper elevation above grade (usually six to twelve inches). The concrete should be allowed to cure for a minimum of forty eight hours before disturbing.

Next, the upper members (18) of the vertical support members (16) are inserted into the lower members (20). The manufactured building (11) is then moved over the vertical support members (16).

Next, the intermediate support beams (12) are positioned in the beam holders (22). The intermediate support beams (12) are then raised, typically by a hydraulic jack, until the intermediate beams (12) contact the structure's main support beams (14) and the beams (12) and structure (11) reach the desired elevation above grade. The upper vertical support members (18) are then secured with respect to the lower members (20) by inserting the two bolts (40) in the aligned apertures (36 and 38) of the upper and lower members (18 and 20) as shown in FIGS. 5 and 6. If an alternative embodiment of the vertical support member (16) is used, for example, that shown in FIGS. 7 and 8, after the upper member (18) is raised to the proper elevation, the upper members (18) are secured with respect to the lower members (20) by tightening the securing nuts (43) and locking nuts (45) down onto the top of the lower member (20). Depending on the type of beam holder (22) used, dry set grout may be packed around the intermediate support beam (12) in the beam holder (22) as discussed above and shown in FIG. 9. The final step is to secure the structure's main beams (14) to the intermediate beams (12) as discussed above and shown in FIGS. 5 and 7, or FIGS. 10 and 11 depending on the type of main beam (14).

Installation Method of First Alternate Embodiment

When installing the alternative embodiment of the foundation support system (10), wherein helical pier footings (24*b*) (FIG. 2, 4 and 10) are used instead of concrete pier footings (24*a*), the first step is to lay out the locations of the helical pier footings (24*b*) to adequately support the structure (11). The size, number and spacing of the piers (24*b*) depends on the structure (11) and the soil conditions of the site. After the piers (24*b*) are properly laid out, the piers (24*b*) are augured into the soil to the desired depth. The helical pier footings (24*b*) must be plumb as they enter the soil.

After the pier footings (24*b*) are properly set, a shallow circular excavation is made around the lower vertical support member (20) projecting a distance above the soil. A precast or cast-in-place concrete donut (30) is placed over the lower vertical support member (20) and rests in the shallow excavation. The precast donut (30) is then covered with the excavated soil.

Next, the upper members (18) of the vertical support members (16) are inserted into the lower members (20). The manufactured building (11) is then moved over the vertical support members (16).

Next, the intermediate support beams (12) are positioned in the beam holders (22). The intermediate support beams (12) are then raised, and the upper vertical support members (18) are secured with respect to the lower members (20) as discussed above. Finally, the structure's main beams (14) are secured to the intermediate beams (12) as discussed above.

Installation Method of Second Alternate Embodiment

When the location of the building site is in an area where the depth to bedrock is shallow, and the primary concern in the design of the footings (24) is shear and uplift forces due to wind or earthquakes, rock anchored footings (24*c*) (FIG. 12) may be the best alternative. When installing rock anchored footings (24*c*), the first step is to excavate the soil and any weathered rock until a sound bedrock surface (78) is exposed. Holes (76) are drilled into the sound bedrock (78) to a required depth. The holes (76) must be properly positioned such that the holes (76) will line up with the apertures (72) in the baseplate (70). The rock anchors (74) are inserted into the drilled holes (76) and grout (80) is poured into the holes (76) and around the rock anchors (74). When the grout (80) has set, a first set of nuts (86) are threaded onto the rock anchors (74) and positioned so they are approximately 1½ inches above the bedrock (78). The baseplate (70) is positioned over the rock anchors (74) and rests on top of the nuts (86), wherein the rock anchors (74) project through the apertures (72) in the baseplate (70). A second set of nuts (84) are threaded onto the rock anchors (74), thereby securing the baseplate (70) between the nuts (84 and 86) above the bedrock (78) approximately 1½ inches. The space between the baseplate (70) and bedrock (78) is then packed with grout (82). The lower vertical support member (20), preferably welded to the baseplate (70) must be plumb.

The rock anchor footing (24*c*) is then covered with backfill and the upper members (18) of the vertical support members (16) are inserted into the lower members (20). Next, the upper members (18) of the vertical support members (16) are inserted into the lower members (20). The manufactured building (11) is then moved over the vertical support members (16).

Next, the intermediate support beams (12) are positioned in the beam holders (22). The intermediate support beams (12) are then raised, and the upper vertical support members (18) are secured with respect to the lower members (20) as discussed above. Finally, the structure's main beams (14) are secured to the intermediate beams (12) as discussed above.

It should be appreciated that all embodiments of the foundation support system (10) of the present invention, when properly designed and installed, can withstand greater loads than can the dry stack concrete block foundation support systems. For this reason, fewer footings (24) are required. Unlike dry-stack concrete block foundation systems, the structure (11) is firmly secured to the footings (24) and will not shift if the elements comprising the foundation support system (10) are properly secured together. Further, the foundation support system (10) eliminates the need of having to ensure nearly perfect alignment of the structure's main beams (14) and footings (24). The present invention allows the main beams (14) to be slightly skewed or offset from the footings (24), yet still adequately transfer the structural loads to the footings (24) and ultimately to the surrounding soil.

It should also be appreciated that all embodiments of the foundation support system (10) of the present invention are capable of resisting substantial lateral loads and uplift forces if properly designed to do so. Therefore, a properly installed and designed foundation support system (10) of the present invention may eliminate the need for tie-down straps currently used in the industry to resist wind loads on the manufactured buildings (11). When designing the foundation support system (10) to resist lateral and uplift loads, special attention must be given to all bolted and welded connections, as well as the uplift and lateral resistance of the footings (24), the anchorage of the vertical support members (16) to the footings (24), the weight and lateral resistance of the soil, and other appropriate factors.

Although only exemplary embodiments of the invention have been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A foundation support system for manufactured structures having main support beams, said foundation support system comprising:

a plurality of intermediate support beams disposed substantially transverse to the main support beams of the manufactured structure to be supported;

a plurality of substantially vertically disposed helical pier footings each of said helical pier footings comprising an elongated shaft having an upper end and a lower end, said lower end disposed a distance below a ground surface, said upper end extending a distance above the ground surface;

a plurality of precast concrete members having a predetermined thickness and outside dimensions, each of said plurality of precast concrete members further having an aperture disposed substantially along an axis and extending through the thickness thereof, at least one said upper end of said elongated shaft of said plurality of helical piers extending through said aperture of at least one said plurality of precast concrete members such that at least one said plurality of helical pier footings has at least one precast concrete member disposed around said upper end thereof, said at least one plurality of precast concrete members further being disposed in a shallow ground excavation surrounding said upper end of said at least one helical pier footing such that said at least one precast concrete member within said shallow ground excavation provides lateral resistance to any lateral loads that might act upon said helical pier footing;

a plurality of beam holders, each of said beam holders comprising a bottom plate, said bottom plate being disposed between said intermediate support beams and said upper end of said elongated shaft of each said plurality of helical pier footings.

2. The foundation support system of claim 1 wherein said bottom plate of each said plurality of beam holders is fixed to said upper end of said elongated shaft of each said plurality of helical pier footings.

3. The foundation support system of claim 1 wherein each of said plurality of intermediate support beams has an "I" shaped cross-sectional configuration comprised of a web portion disposed between top and bottom flanges.

4. The foundation support system of claim 3 wherein said bottom plate of each of said plurality of beam holders has a width greater than the width of said intermediate support beam bottom flange, said beam holders further comprising two laterally spaced apart inwardly opposing top flanges having a combined width less than the width of said bottom plate minus the width of said intermediate support beam web portion such that said web portion is receivable between said two inwardly opposing laterally spaced apart top flanges, said two inwardly opposing laterally spaced apart top flanges also being vertically spaced above said bottom plate for receiving said intermediate support beam bottom flange therebetween.

5. The foundation support system of claim 4 wherein said two inwardly opposing laterally spaced apart top flanges of each of said beam holders are vertically spaced above said bottom plate of each of said beam holders by two vertical web members such that said beam holder has a "C" shaped configuration in cross-section.

6. The foundation support system of claim 4 wherein said bottom plate and said top flanges of each of said beam holders include apertures for mateably receiving threaded connectors to thereby vertically and laterally restrain said intermediate support beam between said top flanges and said bottom plates.

7. The foundation support system of claim 5 wherein each of said beam holders includes a neoprene pad and a means for retaining said neoprene pads within said beam holder, whereby said neoprene pads dampen earthquake induced lateral loads on the manufactured structure during earthquake loading.

8. The foundation support system of claim 7 wherein said neoprene pad retaining means includes a pair of retainer brackets mountable to said beam holder.

9. The foundation support system of claim 7 wherein said neoprene pad retaining means includes bonding said neoprene pads to said beam holder.

10. The foundation support system of claim 1 further comprising a plurality of upper vertical support members, each of said plurality of upper vertical support members being removably receivable by said upper end of said elongated shaft of each of said plurality of helical pier footings, each of said plurality of upper vertical support members being vertically adjustable with respect to said upper end of said elongated shaft of each of said plurality of helical pier footings.

11. The foundation support system of claim 10 wherein said bottom plate of each said plurality of beam holders is fixed to an upper end of each said plurality of upper vertical support members.

12. The foundation support system of claim 10 wherein each of said plurality of upper vertical support members, and said upper end of said elongated shaft of each said plurality of helical pier footings include a plurality of vertically spaced apertures for mateable alignment for receiving a conventional fastener for vertically adjustably securing said upper vertical support member with respect to said said upper end of said elongated shaft of each said plurality of helical pier footings.

13. The foundation support system of claim 10 wherein each said plurality of upper vertical support members is threadably receivable by said upper end of said elongated shaft of each said plurality of helical pier footings.

* * * * *